United States Patent [19]

Caldwell

[11] Patent Number: 4,764,163

[45] Date of Patent: Aug. 16, 1988

[54] DECANTER PLATE DAM ASSEMBLY WITH POND ADJUSTMENT

[75] Inventor: John W. Caldwell, Glenside, Pa.

[73] Assignee: Pennwalt Corporation, Philadelphia, Pa.

[21] Appl. No.: 864,045

[22] Filed: Jul. 3, 1986

[51] Int. Cl.[4] ..... B04B 3/04; B04B 11/00

[52] U.S. Cl. ..... 494/56; 494/53

[58] Field of Search ..... 494/38, 40, 53, 54, 494/55, 56, 37, 85; 210/781, 782; 422/102, 72

[56] References Cited

U.S. PATENT DOCUMENTS

| | | | |
|---|---|---|---|
| 3,279,687 | 10/1966 | Amerd | 494/56 |
| 3,967,778 | 7/1976 | Hunwick | 494/53 |
| 4,575,370 | 3/1986 | Montagne | 494/56 |

*Primary Examiner*—Robert W. Jenkins

[57] ABSTRACT

Decanter pond level or radius is adjusted incrementally by means of an annular retainer plate having an eccentric recess formed in the surface thereof which faces hub openings. The recess receives a plate dam slidably therewithin. Each retainer plate or retainer, typically 6 in number, is mounted over a hub opening. The dam is mounted over the hub opening such that its weir surface substantially coincides with the rotating pond level. By rotating the retainer around the prepositioned dam in increments preset in the retainer, the dam moves radially inwardly or outwardly depending upon the position of the recess eccentricity with respect to the hub opening. The dam is provided with two different weir surfaces, each usable with a different side of the dam, thus permitting the number of adjustments to the pond level to be doubled. A modification discloses infinite or stepless pond level adjustments.

11 Claims, 6 Drawing Sheets

DECANTER PLATE DAM ASSEMBLY WITH POND ADJUSTMENT

STATEMENT OF THE INVENTION

This invention relates to decanter type centrifuges and more particularly concerns plate dam assemblies used therewith which may be readily adjusted to provide controlled pond radii within the limits afforded by the dam assemblies selected.

BACKGROUND AND SUMMARY OF THE INVENTION

Customers purchasing decanters require the manufacturer of the decanter to supply them with dam plates which provide a range of pond radii for satisfactory process operation. Process personnel from the manufacturer of the centrifuge machine may be required to carry many sets of plate dams in an attempt to obtain the proper radius or pond level to satisfy the customer's needs during initial operation. It is not unusual for these process personnel to carry around 30 pounds of plates. Further, if the available dams fail to produce the proper radius, there is often a delay in getting the dams fabricated to produce specific pond radii after such dimensions are ascertained or agreed upon.

The present invention provides plate dam assemblies which may be mounted directly to existing bowl hubs. One assembly embodiment provides infinite adjustment of pond radii, and other embodiments provide for predetermined incremental adjustments. These adjustments, of course, fall within the limits afforded by that particular set of plate dam assemblies selected.

Past efforts to provide a variable pond level or radius included dam members having an eccentric hole or opening therein and rotating these dams in the hub. These devices generally required the use of costly components and were incapable of providing sufficient arc length of weir surface for the volume of effluent exiting from the bowl. Insufficient dam length results in a large change in liquid radius for a change in feed rate, making performance difficult to control when the pond level must be maintained near the solids discharge radius.

Briefly, the present invention provides a retainer member which is mountable directly in a recess provided in existing hubs. The plate dam is carried in an eccentric recess formed in the rear surface of the retainer. The retainer is rotatable within the hub recess which causes the plate dam to move radially inwardly or outwardly, thus offering a weir surface which provides pond levels of varying radii. The plate dam rotates with the hub; it is not rotated within the eccentric recess of the retainer and always has its weir surfaces substantially normal to the axis of rotation of the bowl to thus coincide with the rotating pond level. Additionally, the plate dams are reversible to provide an additional weir surface to thereby increase the range of adjustability of each dam plate assembly.

DETAILED DESCRIPTION OF THE INVENTION

Figure 1:
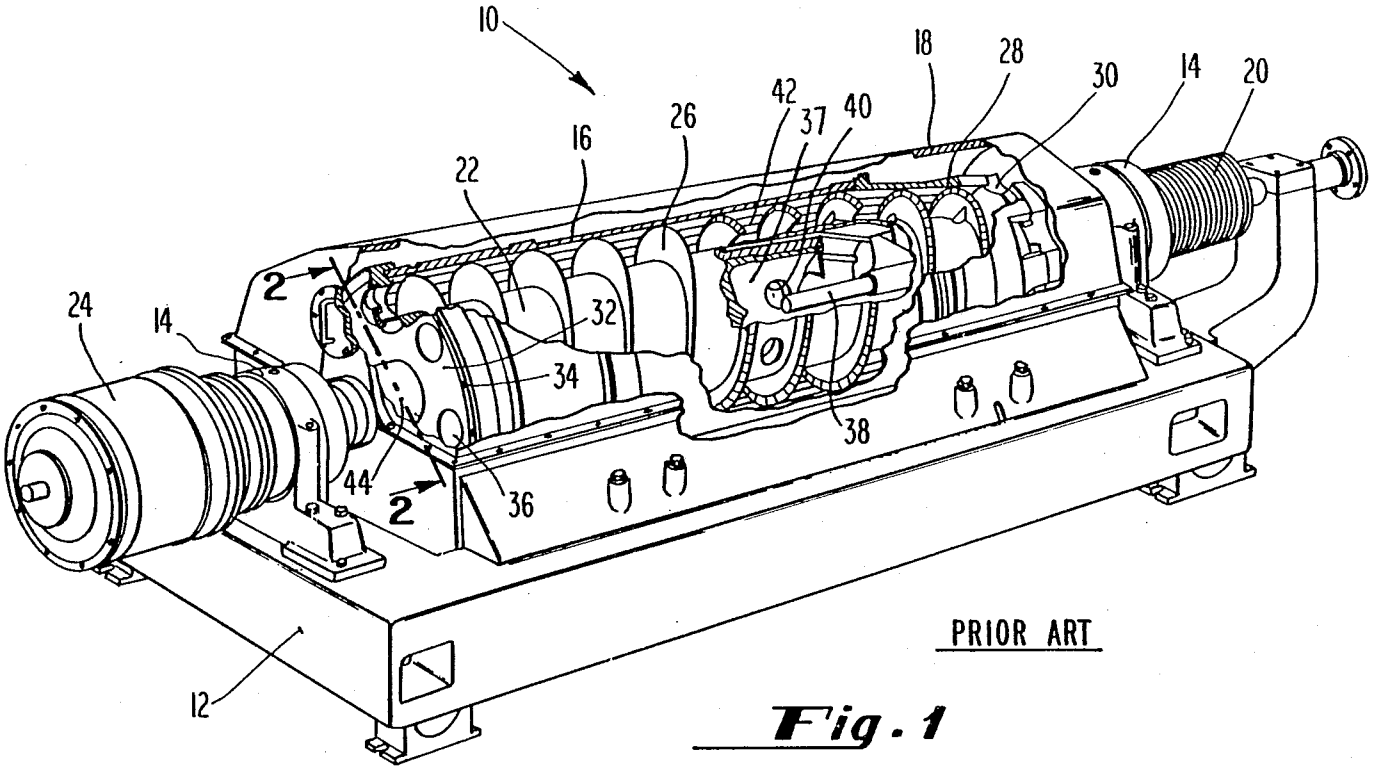
PRIOR ART Fig. 1
FIG. 1 is a perspective view, part in section, of existing or prior art decanter centrifuge apparatus, the front hub member thereof having one of its openings cooperating with a conventional dam member.

In FIG. 1, centrifuge 10 comprises a frame 12 supporting bearings 14 into which are journaled the ends of a hollow, elongated centrifuge bowl 16 of circular cross-section. Bowl 16 rotates about its longitudinal axis within housing 18. Bowl 16 is typically belt driven by a motor (not shown), the belt extending around pulley 20. Bowl 16 rotates at speeds capable of generating a centrifugal force up to several thousand times greater than the force of gravity. Disposed within bowl 16, and mounted coaxially therewith, is a helical screw conveyor 22 adapted to rotate at a speed slightly different from that of bowl 16 by suitable means, typically gear box 24 having torque control means (not shown) and a spline shaft within the bowl shaft connected to conveyor 22. Helical screw conveyor 22 includes coiled screw flights 26, the distal edges thereof generally complementing the inside contour of bowl 16, but spaced a short distance therefrom to provide some clearance therebetween.

Bowl 16 is provided at its rearward end with a tapered or convergent portion 28, commonly referred to as the beach area. Symmetrically arranged around the beach area 28 is a group of solids discharge openings 30.

The front end of bowl 16 is provided with a hub member 32 supported within main bearing 14. Hub 32 may readily be separated from bowl 16 by simply removing bolts 34 adjacent periphery of the hub. A plurality of spaced openings 36 are provided symmetrically uniformly in hub 32 for discharge of the separated liquids therethrough into a liquid discharge duct or chamber (not shown).

Helical screw conveyor 22, being hollow, defines an area therewithin designated feed chamber 37. The process feed stream, or liquids-solids mixture to be separated, is introduced into feed chamber 37 through an axially extending feedpipe 38. The mixture is next delivered through a plurality of radial passages 40 disposed within helical screw conveyor 22 into a separation chamber 42 exteriorly conveyor 22 and interiorly bowl 16. By virtue of the controlled differential in the speeds of rotation of conveyor 22 and bowl 16, the solids are urged up the beach 28 for discharge through openings 30 while simultaneously therewith the liquids are discharged through hub openings 36.

Figure 2:
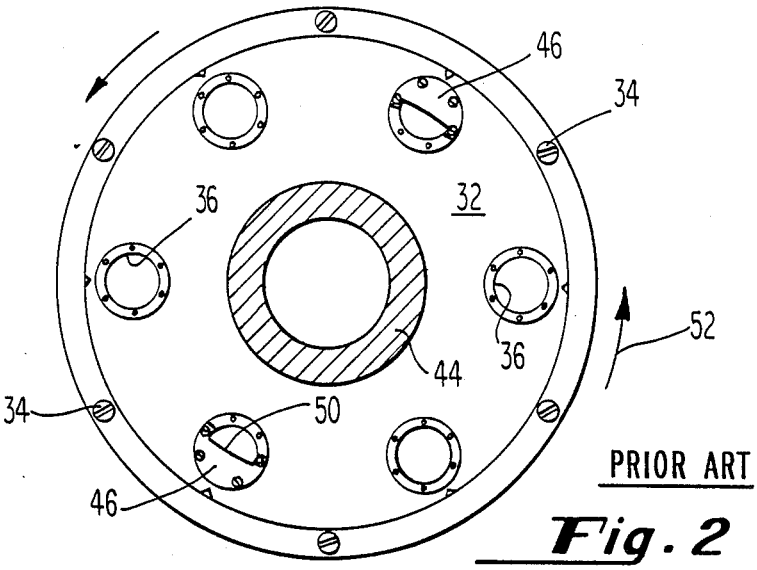
FIG. 2 is a view of the prior art front hub member of FIG. 1 (the hub shaft shown in section), looking in the direction of arrows 2—2, including a pair of conventional dam members mounted in operable position.

Referring now to FIG. 2, bowl 16 and hub 32 rotate as a unit through hub shaft 44. Each opening 36 cooperates with a conventional dam 46 (only two shown) screw mounted to hub 32, or the dam may be formed integrally with the hub. Dam 46 is provided with a curved weir surface 50 which substantially coincides with the level of pond liquid during rotation of the bowl. Arrows 52 indicate the direction of rotation of hub 32.

Figure 3:
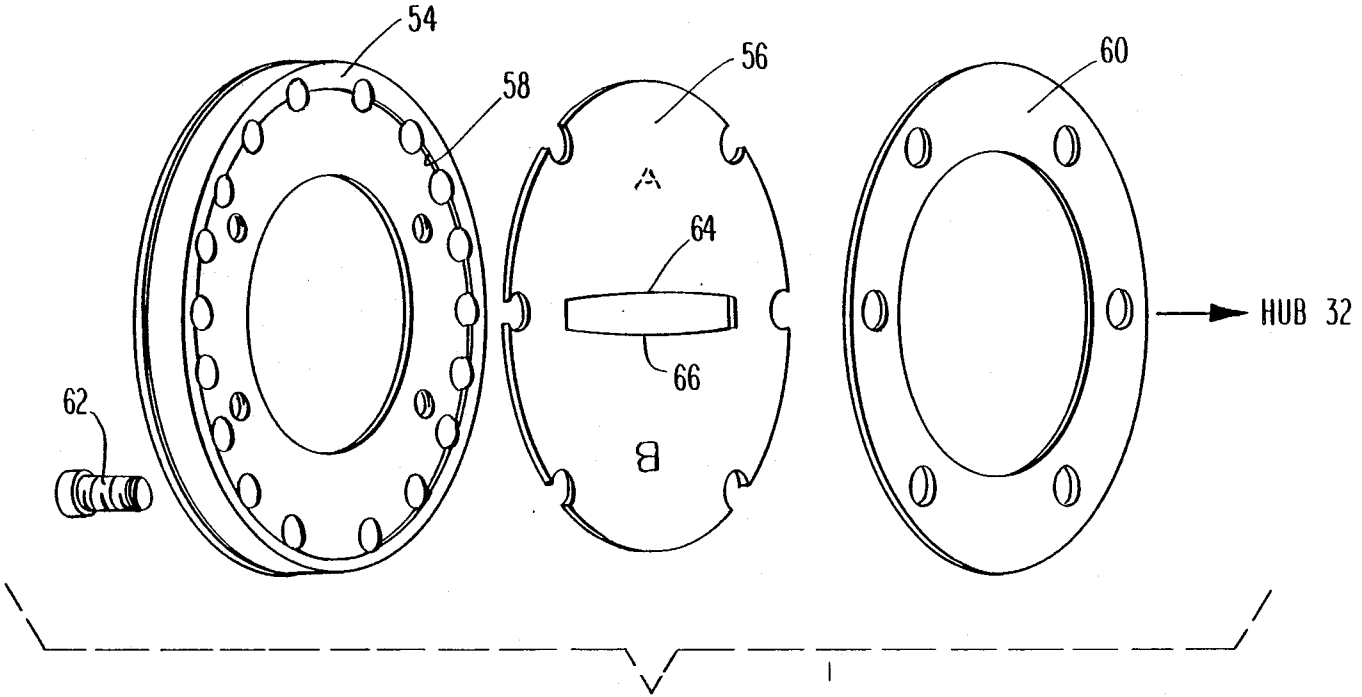
FIG. 3 is an exploded perspective view of an embodiment of the decanter plate dam assembly of the present invention.

In FIG. 3, an embodiment of the present invention includes an eccentric retainer member 54 and a plate dam member 56.

Retainer 54 receives plate dam 56 snugly and slidably within an eccentric recess 58 formed in a rear face of the retainer. Retainer 54, with plate dam 56, and gasket 60, forming a plate dam assembly, are screw mountable to hub 32 at openings 36 by means of mounting screws 62. Typically, hub 32 will have 6 such assemblies mounted thereto spaced uniformly therearound. The present device is also usable with mounting studs extending from the hub.

The two faces of plate dam 56, i.e., side A and side B, the latter shown in phantom and reversed, are employed to achieve twice the number of different pond level settings. Side A utilizes weir surface 64 to control the pond level. By turning the plate dam over in a vertical plane, weir surface 66 of side B will control the pond level. Each of the differing level weir surfaces 64 and 66 is machined or otherwise formed into the dam plate to provide the different sets of pond levels or radii.

Retainer 54 is typically provided with 18 uniformly spaced holes adjacent the periphery thereof, i.e., the centers of each hole are spaced at 20° intervals. The embodiment shown in FIGS. 4, 5 and 6 require 6 mounting screws 62 for each retainer or plate dam assembly. The total number of holes for each retainer 54 therein is desirably a multiple of 6, i.e., 6, 12, 18 etc. If 3 or 4 mounting holes in hub 32 are employed, for example, then the number of holes in the eccentric retainer 54 would be multiples of each respectively. In order to accommodate specific radial increments in the position of the weir surface, the holes provided in the retainer need not be evenly spaced.

Two holes of retainer 54 are not employed for adjusting or controlling the pond level (later described); hence a total of 32 different pond settings are available with retainer 54 and cooperating plate dam 56 including sides A and B.

Gasket 60 merely provides a fluid tight sealing arrangement between retainer 54 and hub openings 36 to insure against leakage of effluent therebetween.

Each plate dam assembly is mounted to the hub such that weir surfaces 64 and 66 substantially coincide with the rotating pond surface by simply aligning marks or letters inscribed on the plate dam with a corresponding mark 68 on the hub. It is emphasized that plate dam 56, once positioned with respect to the hub, is not rotatable within the retainer; its weir surfaces move radially inwardly or outwardly in response to the rotational adjusting movement of the retainer around the plate dam.

Figure 4:
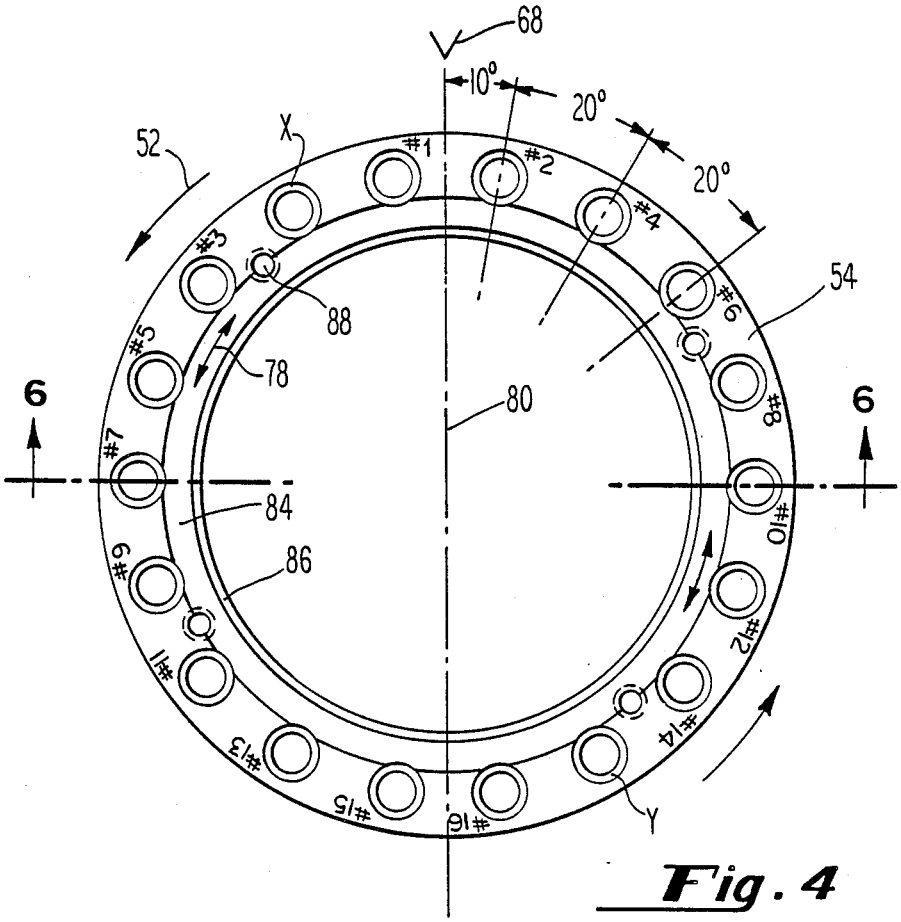
FIGS. 4 and 5 are elevational views of the front or outer face, and rear or inner face respectively of the retainer member.
Figure 5:
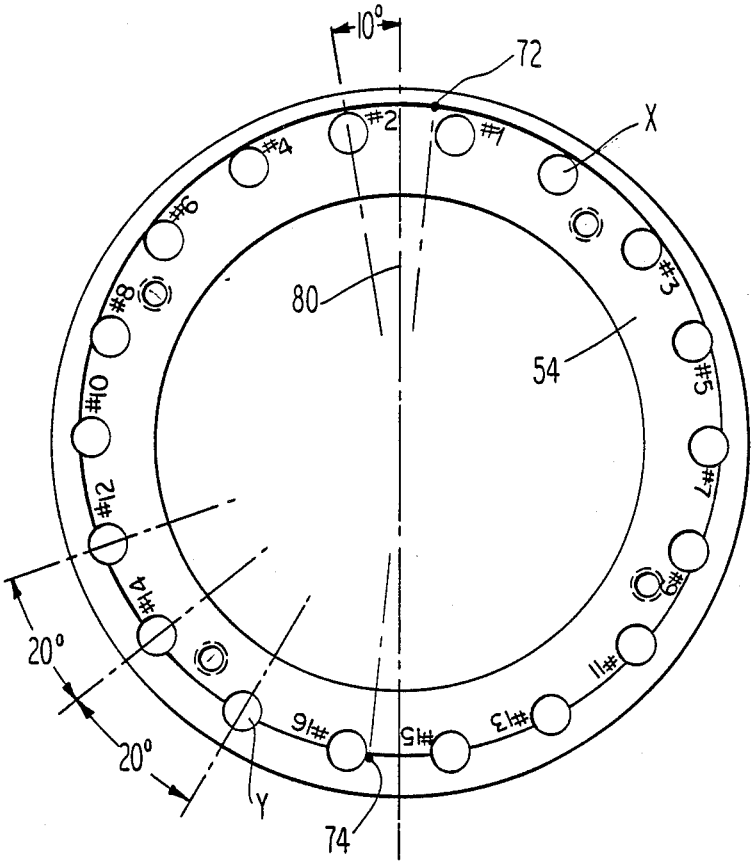
Figure 6:
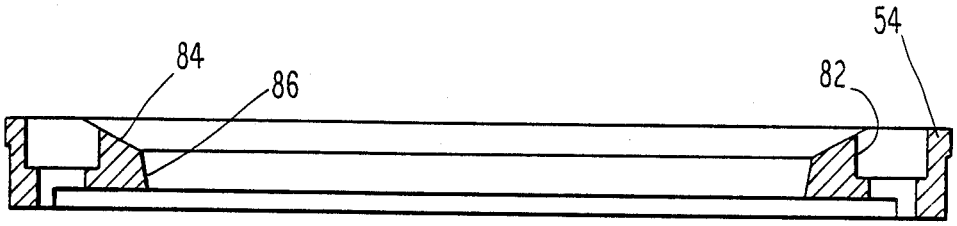
FIG. 6 is a sectional view of FIG. 4 taken along line 6—6 thereof.
Figure 7:
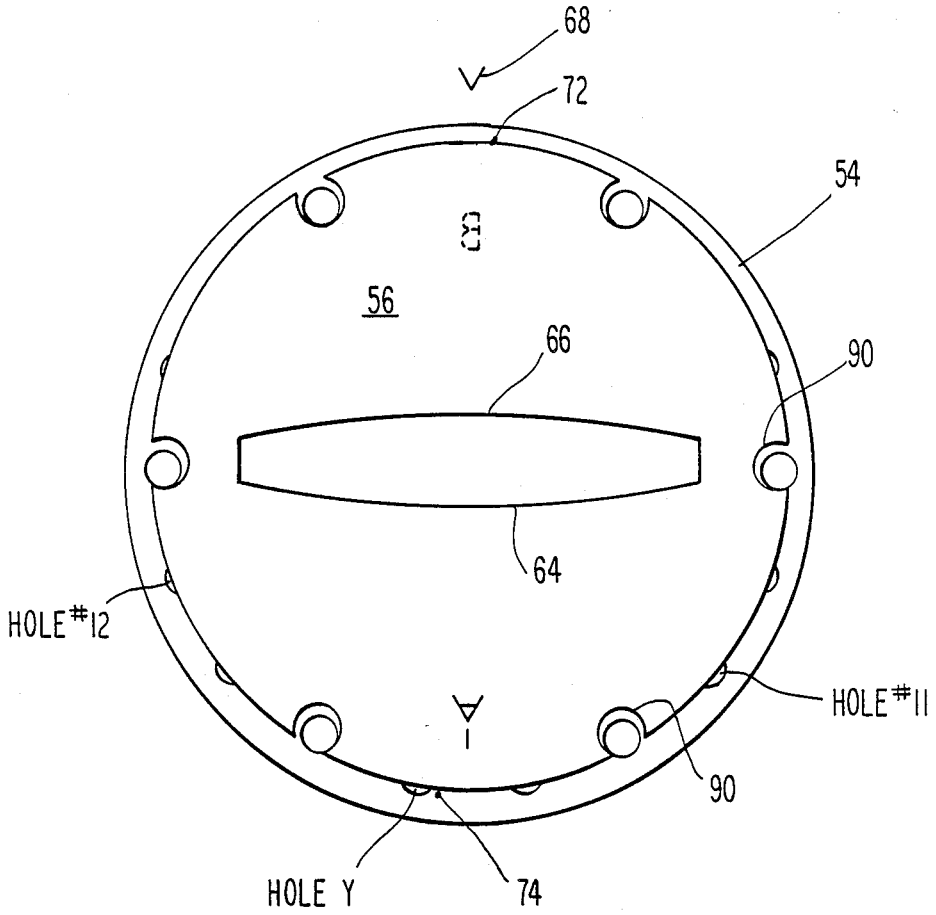
FIG. 7 is a view of the retainer member of FIG. 5 with a plate dam operably engaged therewith.

The annular shaped retainer 54 of FIGS. 4, 5 and 6 is suitably approximately 6" in diameter and made conveniently of stainless steel. The holes are provided with numerals adjacent thereto from 1 through 16. As aforementioned, two of the holes (designated X and Y) are not employed for adjusting or controlling the pond level, since only an extremely minimal change in the pond level would result by their use. More specifically, the points of maximum and minimum distances between eccentric recess 58 and outside diameter of retainer 54 are indicated at 74 and 72 respectively, shown clearly in FIGS. 5 and 7. Thus, when retainer 54 and plate dam 56 are positioned as shown in FIG. 7, with point 72 positioned at its most distant radial position from the hub axis, weir surface 66 provides a pond level shallower than for any other point in the recess when retainer 54 is rotated around the plate dam. Conversely, when retainer 54 is rotated such that point 74 is positioned on hub 32 most distant from the rotational axis of the hub, the pond level will be at its deepest, or closest to the center or axis of rotation of the bowl. As is apparent from FIG. 5, hole X and hole #2 are displaced substantially equally on opposite sides of point 72. The degree of radial displacement at these holes is almost equal, resulting in the minimal change of pond level just referred to. Similar reasoning is applicable to hole Y and hole #15 on opposite sides of point 74. The proper locations of the 18 uniformly spaced holes in retainer 54 with respect to the eccentric recess 58 formed in the rear face of the retainer is essential to the diverse pond levels attainable with the present device.

Thus, viewing FIG. 5, it is seen that the center of hole #2 is displaced substantially to the left of point 72. Remaining holes are formed at 20° intervals. It should be apparent that none of the holes, i.e., boles #1 through hole #16 will thus produce a similar pond level. Stated differently, if a diameter line 80 is drawn midway between holes #1–#2 and holes #15–#16, and point 72 fell on line 80, then a plurality of pairs of similar pond levels would result.

Each of the illustrated holes is about ⅛" in diameter with a counterbore 82 (FIG. 6) approximately ½" in diameter. The interior portions of the eccentric retainer are optionally formed with a pair of descending slopes 84 and 86. A plurality of jack screw holes 88 is provided in the front or outer face (FIG. 4) of the retainer member to assist in removing the assembly from the hub in more stubborn cases.

Retainer 54 may be made by conventional investment casting processes, including numerals or marks thereon.

Regardless of the hole selected for providing the desired pond radii, the retainer will always be capable of alignment with the 6 mounting hole threads formed in hub 32 for each of the 6 plate dam assemblies. Since the plate dam 56 is eccentrically received within the retainer as shown in FIG. 7, the 6 mounting recesses 90 in dam plate 56 are intentionally formed oversize to accommodate the uniformly spaced mounting screws 62 which become disposed within the recesses 90 slightly non-uniformly.

As discussed above, each plate dam is disposed within the retainer recess 58 such that a predetermined mark 68 on the hub aligns with a corresponding mark on the plate dam. Of course, a selected hole of the retainer to obtain a specified pond radius may also be alignable with a hub mark.

When changing from one retainer hole to another, each of the 6 mounting screws must be removed and then reinserted after the proper retainer hole is in alignment.

The device described above provides incremental or small step adjustments in the pond level. Infinite or stepless pond adjustments may be obtained by the device illustrated in FIGS. 8 and 9.

Eccentric retainer 154 receives a plate dam 156 in an eccentrically disposed recess 158 in a rear face of the retainer as described with the embodiment of FIGS. 4, 5 and 7. The retainer 154 is secured to the hub 132 by means of a clamping ring 159 seated in a recess 161 of the hub and secured thereto by means of a plurality of mounting screws 162. Retainer 154 is provided with a numbered scale as shown to aid in providing or reproducing a specific pond level. The numbers on the scale may be made to correspond with a set of predetermined tabulated pond radii.

Figure 8:
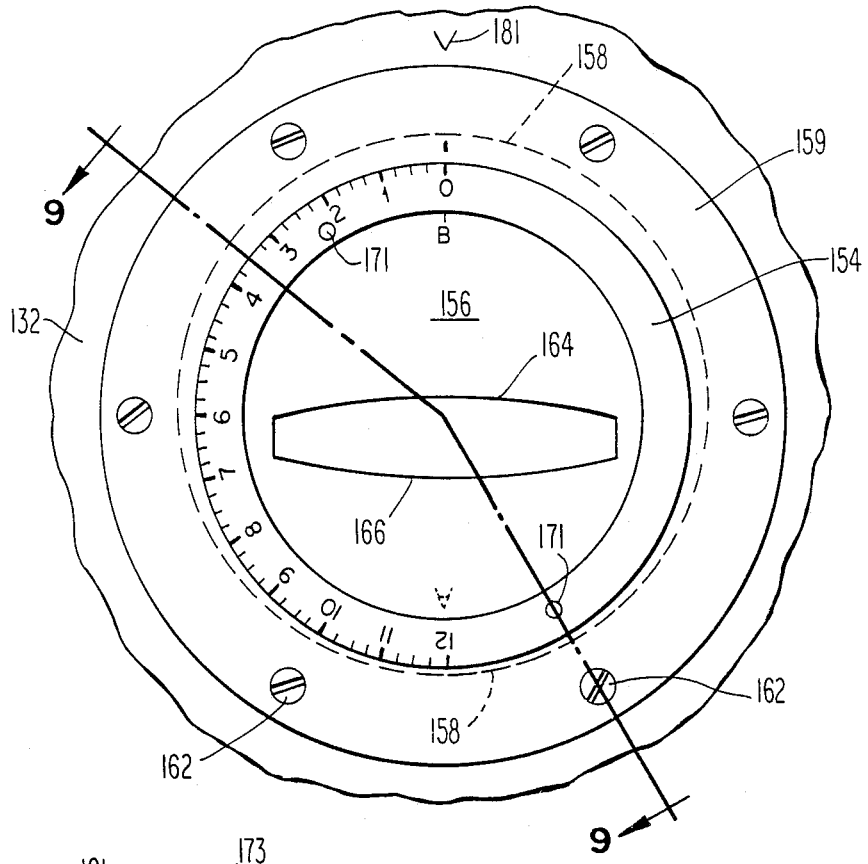
FIG. 8 is an elevational view of a modified plate dam assembly of the present invention.
Figure 9:
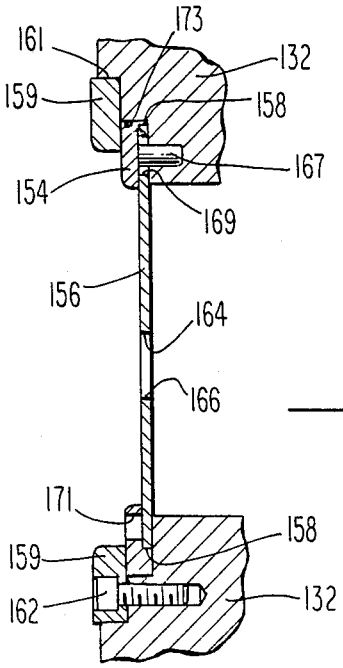
FIG. 9 is a sectional view of the device of FIG. 8 taken along line 9—9 thereof.

Plate dam 156 is formed with weir surfaces 164 and 166, each controlling a pond radius depending upon which side of the plate dam is being used, i.e., side A or side B, the latter being illustrated in FIG. 8.

A pin or pins 167 project from hub 132 (FIG. 9) into recesses or holes 169 provided adjacent the periphery of plate dam 156 to prevent rotation thereof and to insure that the weir surface being used substantially coincides with the rotating pond level. Recesses 169 permit plate dam 156 to move slightly radially inwardly or outwardly as retainer 154 is adjustably rotated theraround. Wrench holes 171 are provided in the retainer to assist in rotation thereof after mounting screws 162 are loosened. Unlike the device of the prior Figures, mounting screws 162 need not be removed but merely loosened in order to rotate the retainer around the plate dam.

In operation, plate dam 156 is properly positioned over the hub opening 36 by means of pins 167. The eccentric recess 158 of retainer 154 receives the positioned plate dam therewithin. The retainer is rotated in either direction within recess 173 formed in hub 132 to bring weir surface 164 (side B) to a desired pond radius. Mounting screws 162 are then tightened which urges clamping ring 159 inwardly against the retainer. Each of the six plate dam assemblies will be so mounted.

It is apparent from the foregoing description that the present apparatus discloses a plate dam assembly which provides a range of stepless or incremental pond level adjustments by the use of a single plate dam thus substantially lessening the number of plate dams required to be carried by process personnel to thereby satisfy the needs and requirements of customers.

I claim:

1. In decanter apparatus for separating liquids from solids from feed comprising a liquids-solids mixture fed into a bowl of said decanter mounted for rotation and including screw means for conveying said solids out a rear portion of said bowl and said liquid out a front portion of said bowl through a plurality of spaced openings in a hub rotating with said bowl, the improvement including a plate dam assembly mounted to said hub over each of said spaced openings, each assembly comprising an annular retainer having an outer surface, and an inner surface facing said hub, a circular recess eccentrically disposed in inner surface of said retainer, a circular plate dam received within said eccentric recess, said dam having at least one weir surface for controlling pond level of said liquid in said rotating bowl, means for maintaining said weir surface in operable position while said hub is rotating, means for rotating said retainer around said positioned dam and weir surface to move said weir surface radially inwardly and outwardly while said weir surface remains operably positioned, and other means for mounting said retainer and plate dam to said hub over said opening.

2. Apparatus of claim 1 wherein an annular gasket is interposed between said hub and inner surface of said retainer.

3. Apparatus of claim 1 wherein said plate dam is provided with 2 weir surfaces, each of said weir surfaces providing a different pond level when a different face of said plate dam is operably positioned over said hub opening and within said eccentric recess of said retainer.

4. Apparatus of claim 1 wherein rotation of said retainer around said positioned dam provides incremental step adjustments of said dam radially inwardly and outwardly.

5. Apparatus of claim 4 wherein said incremental step adjustments are provided by a plurality of evenly spaced holes disposed adjacent periphery of said retainer, said hub having threaded mounting holes spaced evenly about each of said hub openings, number of said holes in said retainer being a multiple of number of said threaded mounting holes disposed around each of said hub openings.

6. Apparatus of claim 5 wherein said eccentrically disposed recess provides a point of maximum distance between said eccentrically disposed recess and outside diameter of said retainer and another point of minimum distance between said eccentrically disposed recess and outside diameter of said retainer, said points being in substantially diametric opposition to each other, said evenly spaced holes in said retainer being asymmetrically disposed about a line drawn through said points.

7. Apparatus of claim 5 wherein each of said threaded mounting holes is aligned with a different one of said holes disposed in said retainer, and wherein rotation of said retainer around said dam in either direction by any number of incremental step adjustments permits each of said threaded mounting holes to remain aligned with a different one of said retainer holes.

8. Apparatus of claim 1 wherein rotation of said retainer around said positioned dam provides stepless adjustments of said dam radially inwardly and outwardly.

9. Apparatus of claim 8 wherein said plate dam is maintained in operable disposition by at least one positioning pin extending from said hub into a radial slot or slots provided at peripheral portions of said plate dam.

10. Apparatus of claim 8 wherein said positioned dam is received within said eccentrically disposed recess of said retainer, and said retainer is secured to said hub during rotation thereof by a clamping ring mounted to said hub.

11. Apparatus of claim 10 wherein said plate dam is provided with 2 weir surfaces, each of said weir faces providing a different pond level when a different face of said plate dam is operably positioned over said hub opening and within said eccentric recess of said retainer.

* * * * *